United States Patent [19]

Miller

[11] 4,150,447

[45] Apr. 24, 1979

[54] MATTRESS CONSTRUCTION

[76] Inventor: Curtis G. Miller, 2905 N. Bristol, Apt. L, Santa Ana, Calif. 92706

[21] Appl. No.: 801,349

[22] Filed: May 27, 1977

[51] Int. Cl.[2] ..... A47C 27/10

[52] U.S. Cl. ..... 5/371; 5/367

[58] Field of Search ..... 5/365, 367, 368, 369, 5/370, 371

[56] References Cited

U.S. PATENT DOCUMENTS

| | | | |
|---|---|---|---|
| 3,766,579 | 10/1973 | Shields | 5/371 |
| 3,802,004 | 4/1974 | Whitney | 5/371 |
| 3,864,768 | 2/1975 | Fraige et al. | 5/371 |
| 3,925,835 | 12/1975 | Pennington et al. | 5/371 |
| 3,983,587 | 10/1976 | Gorran | 5/371 |

*Primary Examiner*—Mervin Stein
*Assistant Examiner*—Alex Grosz
*Attorney, Agent, or Firm*—Richard L. Myers

[57] ABSTRACT

In a mattress construction, a first flexible bag having a first cavity encloses a separate second flexible bag having a second cavity and a separate third flexible bag having a third cavity and extending around the periphery of the second bag. A first valve extending through the first bag and the second bag provides means for filling the second cavity with water. A second valve extending through the first bag and the third bag provides means for filling the third bag with air. A third valve extending through the first bag provides means for bleeding air from the first cavity during the filling of the second and third cavities. A method for constructing the mattress includes steps for attaching the second bag and the third bag to the first bag during the construction of two subassemblies.

16 Claims, 8 Drawing Figures

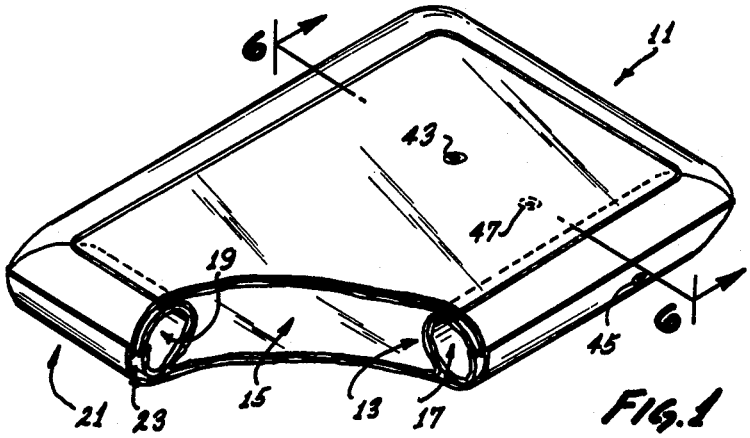
FIG. 1
FIG. 2
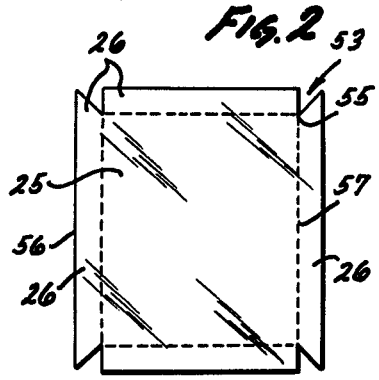
FIG. 3
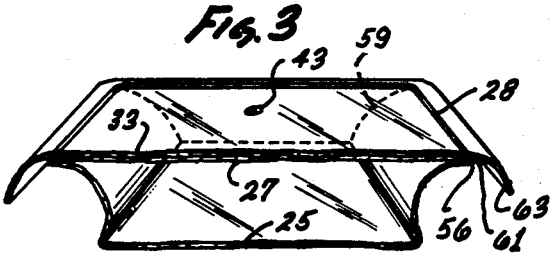
FIG. 4
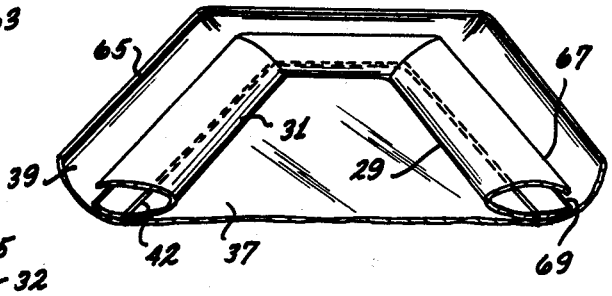
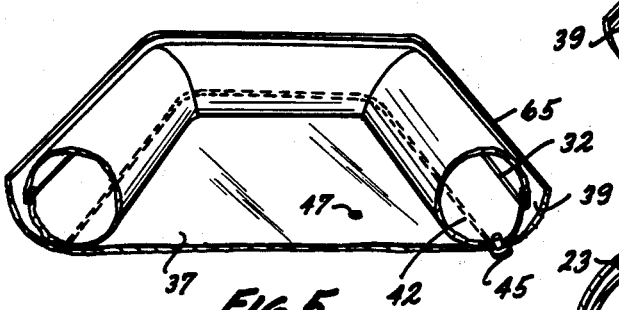
FIG. 5
FIG. 7
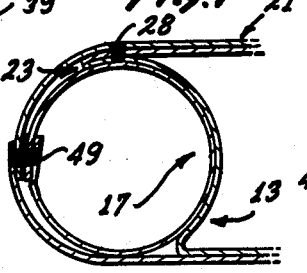
FIG. 8
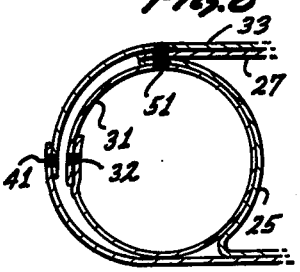
FIG. 6
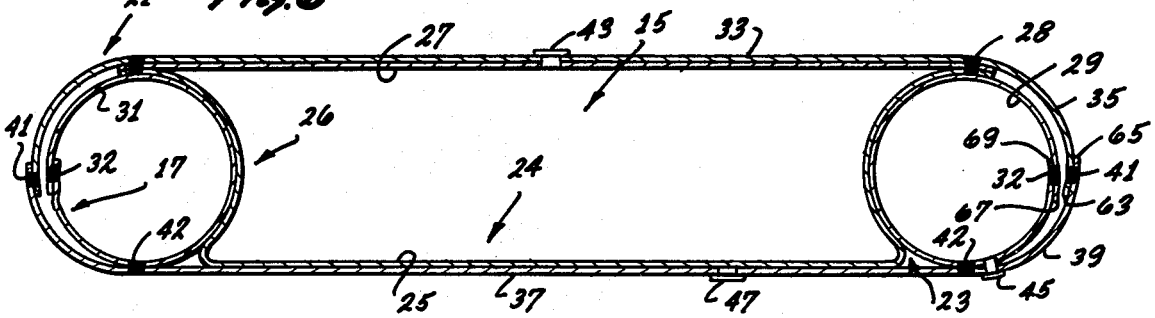

MATTRESS CONSTRUCTION

BACKGROUND OF THE INVENTION

1. Field of the Invention

This invention relates generally to liquid fillable mattresses and more specifically to watermattresses having a peripheral airframe.

2. Description of the Prior Art

In the past, watermattresses have included those providing a flexible bladder having a generally rectangular shape and being fillable with a liquid such as water. Such mattresses have demonstrated a tendency to roll off of a flat planar surface so that they typically have been used with a wood frame having upstanding side members. These side members, in combination with the base of the frame, have defined a cavity for receiving the water bladder. The upstanding side members make it difficult to get in and out of bed and are particularly uncomfortable when one attempts to sit on the edge of the bed.

Watermattresses of this type have been provided with unitary sheet configurations and a preferred lap seam construction as disclosed by B. Kuss in U.S. Pat. No. 3,753,823. A highly desirable bladder configuration providing a relatively square corner construction is disclosed by Craig S. Miller in copending application Ser. No. 754,015 filed Dec. 23, 1976 now U.S. Pat. No. 4,115,886.

In another type of watermattress construction, more analogous to the present invention, an airframe is provided peripherally of the water bladder. This construction has alleviated the necessity of providing the relatively hard and narrow upstanding side members of a wood frame. Thus, this mattress is suitable for use on a simple planar surface. Mattresses exemplary of this type of construction are disclosed by Cantillo in U.S. Pat. No. 3,918,110, and by Pennington in U.S. Pat. No. 3,925,835. Although these particular mattresses have provided the advantages associated with an airframe, their complicated constructions have resulted in relatively weak water bladders. As a result of the high pressures occurring in the area of the bladder, the materials forming these mattresses have tended to stretch and bow so that it has been difficult to maintain a rectangular configuration. As a consequence, even these airframe mattresses have been suggested for use with rigid frames having the upstanding side members. Such a combination is suggested for example, by Fraige in U.S. Pat. No. 3,864,768.

In some of these airframe constructions, an inner wall is provided which separates the water cavity from the peripheral air cavity. If the integrity of this inner wall is broken due to puncture or decay, the water in the bladder is free to escape into the air cavity at the peripheral regions of the mattresses. Once this has occurred, the advantages of an airframe are negated and the mattress is free to roll off of a simple planar surface.

In other types of mattress constructions, an air beam structure has been provided beneath the water bladder in an attempt to reduce the amount of water needed to fill the mattress. Such a construction is disclosed by Shields in U.S. Pat. No. 3,766,579. Mattresses of this type are complexed and difficult to manufacture. They also require a significant amount of material in their construction.

SUMMARY OF THE INVENTION

In accordance with the present construction and method, a mattress having an airframe is provided with the preferred all lap seam construction. This mattress provides a simple construction with a minimum amount of material. High structural integrity is maintained in the area of the water bladder to eliminate any stretching and bowing associated with airframe mattresses of the prior art. This mattress is also desirable since a collapse of the peripheral airframe is not necessarily accompanied by a flow of the water to the peripheral regions of the mattress. As a result, the safety and integrity of the mattress can be depended upon even when supported by a simple planar surface.

The mattress includes a first bag having a generally rectangular configuration which forms the water bladder. A second bag having a tubular configuration is disposed peripherally of the water bladder and provides the airframe for the mattress. This tubular bag is separate from the water bladder in that the walls contacting the air in the tube are different from the walls contacting the water in the bladder. A third outer bag is provided to enclose both the water bladder and the tubular airframe. Thus, the water in the water bladder is separated from the environment in a vertical direction by both the walls of the bladder and the outer bag. In a lateral direction, the water in the bladder is separated not only by the walls of the bladder and the outer bag but also by the walls forming the tubular airframe.

Valves can be provided to extend through the outer bag into the water cavity associated with the bladder, and also to extend through the outer bag into the air cavity associated with the tube. A third valve extending only into the outer bag provides means through which air can be bled from the outer bag as the water bladder and airframe are being filled.

It is of further advantage that this mattress can be constructed by merely integrating two subassemblies. In a first assembly, the water bladder can be formed and joined to a top sheet associated with the outer bag. In a second subassembly, the tube can be formed with the preferred lap seam construction and joined to a sheet forming the bottom of the outer bag. Then by simply joining the peripheral edges of the top and bottom sheets, the outer bag is formed to complete the mattress construction.

In other embodiments of the invention, it may be desirable to attach the tube to the outer bag by forming a single seal which simultaneously closes the tube and attaches the tube to the outer bag.

In still a further embodiment, the tube may be attached to the outer bag at the same point where the water bladder is attached to the upper sheet of the outer bag.

These and other features and advantages of the invention will become more apparent with a description of preferred embodiments and reference to the associated drawings.

DESCRIPTION OF THE DRAWINGS

FIG. 1 is a perspective view partially in section of one form of a preferred embodiment of the invention;

FIG. 2 is a top plan view of a sheet adapted for use in forming a bladder in the embodiment of FIG. 1;

FIG. 3 is a frontal perspective view partially in section of a first subassembly associated with the embodiment of FIG. 1;

FIG. 4 is a frontal perspective view partially in section of the mattress prior to formation of a second subassembly associated with the embodiment of FIG. 1;

FIG. 5 is a frontal perspective view partially in section of the second subassembly associated with the embodiment of FIG. 1;

FIG. 6 is a cross section view taken along the lines 6—6 of FIG. 1;

FIG. 7 is a fragmentary cross sectional view of an additional embodiment of the mattress of the present invention; and FIG. 8 is a fragmentary cross sectional view of a further embodiment of the mattress of the present invention.

DESCRIPTION OF PREFERRED EMBODIMENTS

A mattress having a preferred airframe and lap seam construction is illustrated in FIG. 1 and designated by the reference numeral 11. The mattress 11 includes a first bag or bladder 13 having a generally rectangular configuration in horizontal cross section and providing a first cavity 15 suitable for filling with a liquid such as water. This first bag 13 has fluid tight integrity by itself and provides a water bladder for the mattress 11.

The mattress 11 also includes a second bag or tube 17 which has a generally rectangular configuration and extends peripherally of the bladder 13 around circumference thereof. The tube 17 forms a continuous air cavity 19 around the bladder 13. The walls of the tube 17 are separate from the walls of the bladder 13 although they typically have a contiguous relationship at the outer regions of the bladder 13 and the inner regions of the tube 17. The second bag 17 has fluid tight integrity by itself and provides an airframe for the mattress 11.

The mattress 11 further includes a third bag or envelope 21 which defines a third cavity 23 for receiving both the bladder 13 and the tube 17. The envelope 21 is similar to the bladder 13 in that it also has a generally rectangular configuration in horizontal cross section. The bladder 13 is disposed within the cavity 23 centrally of the envelope 21. The tube 17 is disposed in the peripheral regions of the cavity 23 between the peripheral walls of the bladder 13 and the peripheral walls of the envelope 21.

The materials forming the bladder 13, the tube 17, and the envelope 21 can be any flexible, substantially fluid impervious material preferrably having heat sealable characteristics. Some plastic materials such as polyvinylchloride have these properties.

In a preferred embodiment of the invention, illustrated in FIGS. 1 and 6, the water bladder 13 includes a sheet 25 having bottom portions 24 which extends along the bottom of the mattress 11 and side portions 26 which extend upwardly to form the sides of the bladder 13. It is these upwardly extending side portions 26 of the sheet 25 that form the peripheral regions of the bladder 13 which are in contiguous relationship with the tube 17 in this embodiment. In another embodiment, the bottom and side portions 24 and 26 respectively of the bladder 13 may be provided by separate sheets. A sheet 27 is joined by a seal 28 to the edges of the sheet 25 to complete the bladder 13 and define the water cavity 15. As illustrated in FIG. 6, the side portion 26 may have a concave configuration which extends inwardly and then outwardly with progressive positions from the bottom portions 24 to the sheet 27.

The tube 17 can include four sheets of material two of which are designated by the numerals 29 and 31 in FIG. 6. Each of these four sheets, such as the sheets 29 and 31, form one of the side sections of the rectangular tube 17. Each of the sheets has substantially parallel longitudinal edges which are brought into overlapping relationship and connected to each other by a circumferential seal 32. These sections are joined at the corners of the tube 17 to form the continuous peripheral air cavity 19.

It is of particular interest to note that the sheet 25 which forms the sides of the bladder 13 is different than the sheet 29 which forms the side walls of the tube 17. In other words, the bladder 13 and the tube 17 are separate bags which do not share any common walls. This dual wall construction not only provides a high degree of flexibility between the bladder 13 and the tube 17, but also increases the integrity of the mattress 11 in this critical region.

In the illustrated embodiment, the outer envelope 21 defining the cavity 23 includes a top sheet 33 which is disposed in contiguous relationship with the sheet 27 of the bladder 13. This sheet 33 has marginal regions 35, however, which extend beyond the side portions 26 of the sheet 27. A bottom sheet 37 of the envelope 21 is disposed in contiguous relationship with the bottom portion 24 of the sheet 25. This sheet 37 also has marginal regions 39 which extend beyond the side portions 26 of the bladder 13. The marginal regions 35 of the sheet 33 and the marginal regions 39 and the sheet 37 are bent around the outer wall of the tube 17 and joined to form a lap seam 41.

In this construction, the tube 17 has a tendency to occupy the peripheral regions of the envelope 21. With these regions thus occupied and the bladder 13 otherwise enclosed by the envelope 21, the bladder 13 has a tendency to remain in the central regions of the mattress 11. Nonetheless, it may be desirable to attach the bladder 13 and the tube 17 to the envelope 21 in these preferred positions. Thus, in the illustrated embodiment, the four sheets which form the tube 17, such as the sheet 29 and 31, can be attached to the sheet 37 forming the bottom of the envelope 21. This means of attachment can be a heat seal 42 extending continuously along the bottom of the tube 17 inwardly of the marginal regions 39 of the sheet 37.

The bladder 13 can be attached to the envelope 21 by extending the seal 28 to include the sheet 33. Thus the seal 28 would not only join the edges of the sheets 25 and 27 to form the bladder 13, it would also attach the bladder 13 to the sheet 33. With respect to the sheet 33, the seal 28 extends continuously around the mattress 11 inwardly of the marginal regions 35.

A valve 43 extending through the sheet 33 of the envelope 21 and the sheet 27 of the bladder 13 provides access to the water cavity 15. Access to the air cavity 19 can be provided in the form of a valve 45 extending through the marginal regions 39 of the sheet 37 and one of the sheets forming the tube 17, such as the sheet 29.

A valve of particular interest to this mattress construction is that illustrated in FIG. 6 and designated by the reference numeral 47. This valve 47 extends through the sheet 37 to provide access to the cavity 23 of the envelope 21. The valve 47 is provided not to fill the cavity 23, but rather to bleed air from the cavity 23 during the filling of the bladder 13 and the tube 17. Since the envelope 21 provides an enclosure by itself, the expansion of the bladder 13 and the tube 17 during the filling thereof tends to compress air in the cavity 23 into the unoccupied regions thereof. It is this air which is to be bled through the valve 47. Although the valves 43, 45, and 47 can be located in different positions on the mattress 11 to provide access to the cavities 15, 19 and 23 respectively, it is at least desirable that the valves 43 and 47 be located on opposite sides of the mattress 11.

This mattress construction is of particular advantage for several reasons. One will first notice that the bladder 13 is attached to the envelope 21 only along one side of the mattress. This has been found to be highly desirable since it gives the bladder 13 a high degree of flexibility relative to the tube 17 and the envelope 21. The sheet 25, including the upwardly extending side portions 26 thereof is free to move relative to the tube 17 and the sheet 37 which forms the bottom of the envelope 21. This alleviates the stress typically associated with airframe constructions which include an inner wall attached to both sides of the mattress 11.

This construction is also advantageous since it provides a double thickness of material along both the top and bottom of the mattress 11. It is the sheets in these regions which typically undergo significant tensile stresses due to the pressure of the water in the cavity 15. With a double thickness of material in these regions of the mattress 11, the bowing and stretching associated with the mattresses of the prior art is significantly reduced. It will be noted that the additional strength provided by a two wall construction is also achieved between the water cavity 15 and the air cavity 19. Not only is there additional strength in this area but the possibility of leakage from the bladder cavity 15 to the environment is also reduced with the two ply construction. Increased puncture resistance and strength is also achieved at the peripheral edges of the mattress 11 where the sheets of the tube 17, such as the sheet 29, engage the marginal regions 35 and 39 associated with the envelope 21.

The multiwall construction is of further advantage in maintaining the water within the mattress 11. In order for the water to escape from the top or the bottom of the mattress, it would have to pass thru two walls of material. In order for the water to escape laterally of the mattress 11, it would have to pass thru four walls of material.

In other embodiments of the invention, the seal 32 associated with the tube 17 and the seal 41 associated with the envelope 21 can be made integral as illustrated in FIG. 7. In this embodiment, a single seal 49 is formed between the longitudinal edges of the sheets forming the tube 17 such as the sheet 29, and the edges of the marginal regions 35 and 39 of the sheets 33 and 37 respectively. Then, the seal 49 can provide means for sealing the tube 17, means for sealing the envelope 21, and means for attaching the tube 17 to the envelope 21.

In still a further embodiment of the invention, the tube 17 can be attached to the envelope 21 by extending the seal 28 to include the sheets forming the tube 17, such as the sheet 29. In such an embodiment, a single seal 51 illustrated in FIG. 1, would extend through the sheets 25, 27, 31 and 33. Then, the seal 51 can provide means for sealing the tube 17, means for sealing the bladder 13, and means for attaching the tube 17 and the bladder 13 to the envelope 21.

A preferred method for constructing the embodiment of FIG. 6 is illustrated in FIGS. 2 through 6. The sheet 25 associated with the bladder 13 can be provided in the form of a rectangle having edges 56 wherein each of the corners of the rectangle is cut to form a notch 53 having an apex 55. The sheet 25 can be bent along lines 57 which are dotted in FIG. 2 and extend between adjacent pairs of the apices 55. The marginal regions defined by the dotted lines 57 and the edges 56 will ultimately form the side portions 26 of the bladder 13. With the sheet 25 bent along the dotted lines 57, the edges which form the notches 53 will be brought into engagement. Associated pairs of these edges can be attached to each other by means of a heat seal 59 to close the associated notch 53, and thereby to form the bottom portions 24 and the side portions 26 of the bladder 13.

In the next step of the preferred method of construction, the sheet 27 having the configuration of a rectangle defined by edges 61 can be brought into overlying relationship with the sheet 25, with the edges 56 and 61 being coextensive in an outwardly direction.

The sheet 33 forming the top of the envelope 21 can then be brought into overlying relationship with the sheet 27. The sheet 33 has a generally rectangular configuration and is defined by edges 63 which extend beyond the edges 56 and 61. With the sheet 27 overlying the sheet 25, and the sheet 33 overlying the sheet 27, the heat seal 28 can be formed as illustrated in FIG. 1. The valve 43 can be provided to extend through the sheet 33 and the sheet 27 to complete the construction of this subassembly.

In a second subassembly, the sheets associated with the tube 17, such as the sheets 29 and 31, can be joined as disclosed and claimed by Craig S. Miller in copending application Ser. No. 763,305 filed Jan. 28, 1977, now abandoned. However, prior to formation of the seal 32 which encloses the tubular cavity 19, the seal 42 can be formed between the sheets forming the tube 17, such as the sheet 29 and 31, and the sheet 37 of the envelope 21. This seal 42 is illustrated in FIG. 4 wherein it will be noted that the sheet 37 is defined by edges 65. In this embodiment, the marginal portions 39 of the sheet 37 extend between the seal 42 and the edges 65.

After the seal 42 is completed, the seal 32 can be formed as illustrated in FIG. 5. Finally, the valve 45 can be provided to extend through the marginal portions 39 of the sheet 37 and the sheet 29 of the tube 17. Provision of the valve 47 which extend through sheet 37 completes this subassembly which is illustrated in FIG. 5.

A next step in the preferred method may be to bring the first subassembly into registration with the second subassembly. Thus, the assembly as illustrated in FIG. 3 could be moved downwardly onto the subassembly as illustrated in FIG. 5 until the edges 63 of the sheet 33 are brought into overlapping relationship with the edges 65 of the sheet 37. The seal 41 can then be formed between the overlapping marginal portions 35 and 39 of the sheets 33 and 37 respectively.

It is desirable that the overlapping relationship of the edges 67 and 69 associated with the tube 17 be coordinated with the overlapping relationship of the edges 63 and 65 associated with the envelope 21. Preferrably, the edge disposed on the outside of the seal 32 should extend in the same direction as the edge disposed on the inside of the seal 41. This will inhibit any interlocking of these edges which are disposed in contiguous relationship. For example, as illustrated in FIG. 6, the edge 67 of the sheet 29 can be disposed outwardly of the edge 69 of the sheet 29. In such an embodiment, it is desirable that the edge 63 associated with the marginal portion 35 be disposed inwardly of the edge 65 associated with the marginal portion 39. In the embodiment illustrated in FIG. 6, both the contiguous edges 63 and 67 extend in a common, downwardly direction.

This method of construction is particularly desirably because it provides for subassemblies which can be easily formed and set aside pending final construction of the mattress 11. This method also provides easy access to the various cavities 15, 19, and 23 during formation of the various seals.

In accordance with this preferred method, the mattress 11 is provided with structural characteristics which provide significant advantages over the mattresses of the prior art. The double wall construction throughout the mattress results in a high degree of integrity while permitting the flexibility needed to accommodate the significant stresses associated with the pressures of the water in the mattress. With the attachment of a water bladder 13 to the envelope 21 on a single side of the mattress, the side portions 26 and at least one of the top or bottom walls of the bladder 13 are free to move relative to the tube 17 and the envelope 21. Each of the tube 17 and the bladder 13 is retained in its preferred location within the envelope 21 by a single heat seal, the seals 42 and 28 respectively. In some embodiments, these means of attachment can be provided by merely extending the various seals associated with the cavities 15, 19 and 23.

The novel valve 47 which extends into the cavity 23 provides means for bleeding air from the cavity 23 as the bladder 13 and the tube 17 are being filled.

Although the mattress and method of construction associated with this invention have been disclosed with reference to specific embodiments and method steps, it will be understood that the invention can be otherwise embodied and constructed so that the scope of the invention should be ascertained only with reference to the following claims.

I claim:

1. Mattress comprising:

a first flexible bag having first walls of substantially fluid impervious material defining a first cavity;

a second flexible bag disposed within the first cavity and having second walls of substantially fluid impervious material different from the first walls and defining a second cavity interiorly of the first bag;

a third flexible bag disposed within the first cavity and having third walls different from the first walls and the second walls and defining a third cavity interiorly of the first bag and exteriorly of the second bag;

means extending through the first walls and the second walls for providing access to the second cavity for filling the second cavity with a first fluid;

means extending through the first walls and the third walls for providing access to the third cavity for filling the third cavity with a second fluid; and the first fluid being isolated from regions exterior of the mattress by at least two of the first walls, second walls, and third walls.

2. The mattress recited in claim 1 further comprising: means for providing access to the first cavity for bleeding air from the first cavity during the filling of the second cavity with the first fluid.

3. The mattress set forth in claim 1 further comprising:

means for attaching the second walls of the second bag to the first walls of the first bag; and means for attaching the third walls of the third bag to the first walls of the first bag.

4. The mattress recited in claim 3 wherein the means for attaching the second walls of the second bag to the first walls of the first bag is integral with the means for attaching the third walls of the third bag to the first walls of the first bag.

5. The mattress set forth in claim 1 wherein the third bag is a hollow tube disposed circumferentially of the second bag within the first bag.

6. A mattress comprising:

a first sheet of substantially fluid impervious material;

a second sheet of substantially fluid impervious material;

first means for attaching the first sheet to the second sheet to form a bladder having a first cavity;

at least a third sheet of material having a first edge and a second edge;

second means for attaching the first edge of the third sheet to the second edge of the third sheet to form a tube having a second cavity, the tube being disposed at least partially peripherally of the bladder;

at least a fourth sheet of substantially fluid impervious material forming an envelope having a third cavity and being disposed to enclose the bladder and the tube;

third means extending through the envelope and the bladder for providing access to the first cavity; and fourth means extending through the envelope and the tube for providing access to the second cavity, whereby;

the first cavity is isolated from regions exterior of the mattress by at least one of the first sheet and the second sheet forming the bladder, and by the fourth sheet forming the envelope.

7. The mattress recited in claim 6 further comprising:

fifth means for attaching the bladder to the envelope with the bladder disposed centrally and interiorly of the envelope.

8. The mattress recited in claim 7 wherein the fifth means is integral with the first means.

9. The mattress set forth in claim 7 further comprising:

sixth means for attaching the tube to the envelope with the tube disposed circumferentially and interiorly of the envelope.

10. The mattress set forth in claim 9 wherein the sixth means is integral with the fifth means and the first means.

11. The mattress recited in claim 6 wherein the fourth sheet of material is defined by peripheral edges and the envelope further comprises:

a fifth sheet of material defined by peripheral edges; and fifth means for attaching the peripheral edges of the fourth sheet to the peripheral edges of the fifth sheet to form the envelope.

12. The mattress set forth in claim 11 wherein the fifth means is disposed in contiguous relationship with the second means.

13. The mattress set forth in claim 12 wherein:

the second means is a lap seam extending around the outer circumference of the tube and the first edge of the third sheet is disposed outwardly of the second edge of the third sheet and extends in a particular direction; and the fifth means is a lap seam and the peripheral edges of the fourth sheet are disposed inwardly of the peripheral edges of the fifth sheet and extend in the particular direction.

14. The mattress recited in claim 12 wherein the fifth means is integral with the second means.

15. The mattress set forth in claim 8 further comprising:

fifth means extending through the envelope to provide access to the third cavity.

16. A watermattress comprising:

a first flexible bag having first walls of substantially fluid impervious material defining a first cavity;

a second flexible bag disposed within the first cavity and having second walls of substantially fluid impervious material defining a second cavity interiorly of the first bag;

a third flexible bag disposed within the first cavity and having third walls different from the first walls and the second walls and defining a third cavity interiorly of the first bag and exteriorly of the second bag;

means extending through the first walls of the first bag and the second walls of the second bag for providing access to the second cavity to permit filling of the second cavity with a liquid;

means extending through the first walls of the first bag and the third walls of the third bag for providing access to the third cavity to permit filling of the third cavity with a gas; and means extending through the first walls of the first bag for providing access to the first cavity to permit the bleeding of air from the first cavity during the filling of the second cavity with the liquid or the filling of the third cavity with the gas.

* * * * *